United States Patent [19]

Macke

[11] 4,004,796

[45] Jan. 25, 1977

[54] CALIPER-STITCH AND TRIM MACHINE

[75] Inventor: Thomas F. Macke, Fort Lauderdale, Fla.

[73] Assignee: Hydrabind, Inc., Miami, Fla.

[22] Filed: Sept. 4, 1973

[21] Appl. No.: 393,914

Related U.S. Application Data

[63] Continuation-in-part of Ser. No. 299,819, Oct. 24, 1972, Pat. No. 3,938,799.

[52] U.S. Cl. ..... 271/94; 270/54; 271/99

[51] Int. Cl.[2] ..... B65H 3/10

[58] Field of Search ..... 271/94–96, 271/99–101, 105, 106, 112, 119, 18.3, 33, 11; 214/8.5 D, 8.5 H; 270/54

[56] References Cited

UNITED STATES PATENTS

| | | | |
|---|---|---|---|
| 1,706,952 | 3/1929 | Broadmeyer | 271/96 |
| 2,033,849 | 3/1936 | Mudd | 271/94 |
| 3,372,924 | 3/1968 | Treff | 271/96 |
| 3,423,084 | 1/1969 | Konazewski | 271/100 |

*Primary Examiner*—Evon C. Blunk
*Assistant Examiner*—Bruce H. Stoner, Jr.
*Attorney, Agent, or Firm*—Malin & Haley

[57] ABSTRACT

A sheet material seperator device that moves one sheet of material at a time from a generally flat, overlying stack of sheets of material by making contact with the lower sheet and thereafter breaking at least the forward portion of the first sheet away from the stack as the first sheet is transferred to a new location. The sheet material separator device includes a moveable first sheet contact member with a generally flat contact surface around a vacuum contact opening with a leading edge forward of a rearwardly positioned boundary line breaking portion. The sheet material separator device has a following surface positioned to prevent direct contact between the following surface and with the first sheet during the initial movement of the first sheet away from the stack. The first sheet contact member moves in an arcuate path away from the stack to separate the first sheet from the overlying sheet.

8 Claims, 9 Drawing Figures

CALIPER-STITCH AND TRIM MACHINE

BACKGROUND OF THE INVENTION

This invention is a continuation in part of the signature-arranging device and method patent application Ser. No. 299,819, filed Oct. 24, 1972, issued Feb. 17, 1976, U.S. Pat. No. 3,938,799 and relates to a new and improved caliper-stitch and trim machine connected to a signature-arranging device.

The original application relates generally to a signature inserting and collating device employed in a bookbinding operation, and specifically to a single device that can be utilized in providing either an array of signatures inserted into each other (inserting signature) or side-by-side (one on top of the other-collating).

The original application discloses a sheet material separator device to which the claims of this application are directed.

In the past, book stitching and trimming machines were complex in design and costly to manufacture. Many such machines positioned the books in a horizontal plane prior to trimming. Other machine systems used memory means connected to the caliper to control the stitching operation in order to prevent stitching incomplete books.

Also in the prior art, two different machines were required for arranging signatures in two different arrays; one to insert them inside each other (inserting) and another for stacking one on top of the other (collating). Having different machines required more space, less flexibility and increased expense. The applicant's signature-arranging device provides a single device which can accomplish either operation utilizing a plurality of single transfer cylinders. The cylinders include the new and improved sheet material separator device.

BRIEF DESCRIPTION OF ONE EMBODIMENT OF THE CALIPER-STITCH AND TRIM MACHINE

In a signature transfer device for moving at least one sheet at a time from a stack of sheets to a transfer position, a sheet material separating device including a moveable a contact member having a generally flat contact surface around a sheet connecting means. The generally flat contact surface includes a forwardly positioned leading edge and a rearwardly positioned boundary line breaking portion. The contact member includes the connecting means positioned between the leading edge and boundary line breaking portion for holding a portion of the sheet to be moved from the stack of sheets. The contact member is driven in an arcuate path relative to the stack of sheets by a drive means. The drive means positions the leading edge and the flat contact surface next to the first sheet of material in the stack of sheets. As the separator device is moved the boundary line breaking portion which is positioned above and rearward of the leading edge of the contact surface, breaks the lower sheet downwardly away from the overlying sheet of material. The surface rearward of the boundary line breaking portion does not initially make contact with the first sheet of material being removed from the stack of sheets. The following surface falls away from the breaking portion and is rearward of the breaking portion. The breaking portion or breaking means aids in separating the sheet of material being removed from the stack of sheets during the initial movement from the stack of sheets.

It is an object of this invention to provide a new and improved sheet material separator device.

Another object of this invention is to provide a boundary line breaking portion of the sheet contact member that is positioned above and rearward of the leading edge of the contact surface to aid in separating the sheet being moved from the overlying stack of sheets.

Another object of this invention is to provide an improved vacuum breaking sheet material separator device for removing a sheet from a stack of sheets.

Another object of this invention is to provide a pickup means that easily removes signatures from a magazine and automatically separates the sheet of material lying on the pickup means from an adjacent overlying sheet of material.

In accordance with these and other objects which will be apparent hereinafter, the instant invention will now be described with particular reference to the accompanying drawings.

PREFERRED EMBODIMENT OF THE INVENTION

Figure 1:
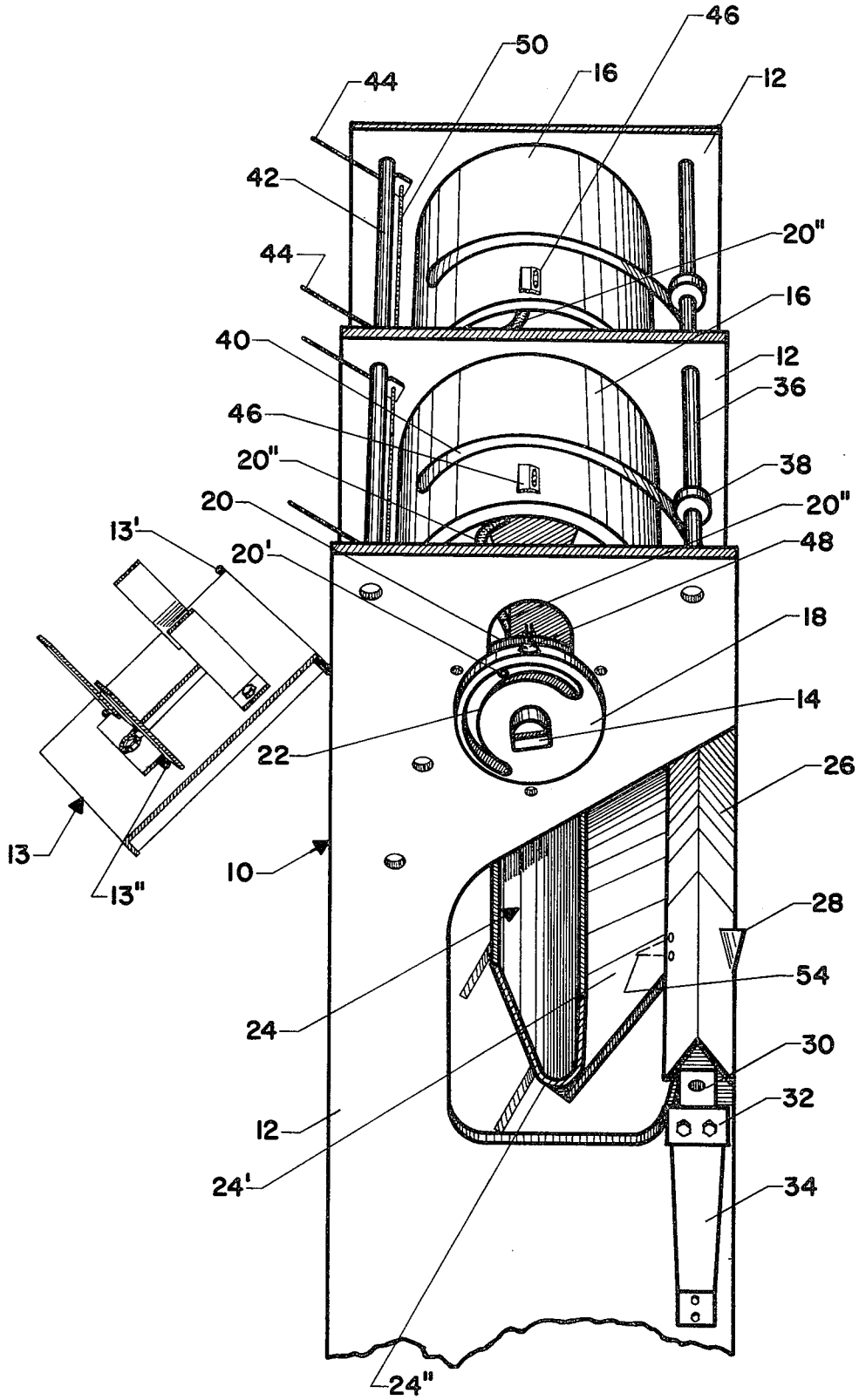
FIG. 1, is a perspective view of a signature-arranging device with the holding magazine exploded away from the housing and showing a sheet material separator device.

Referring now to the drawings, and in particular to FIG. 1, one embodiment of applicant's device is shown generally at 10 comprising a two drum device, the operation being the same at each drum. Any number of drums may be utilized dependant upon the number of different signatures to be inserted or collated.

The device is housed and supported by a plurality of rigid, vertical plates 12 connected together by top cross-bars 36 and 42 and a plurality of bottom cross-bars (not shown). Transfer drums 16 are rotatably mounted on a common shaft between adjacent support plates 12 within vacuum aperture means. Shaft 14 is connected to a fixed special bushing 18 having a vacuum mask chamber 22 and vacuum inlet 48. The movable mask plate 20 coupled and rotating with shaft 14 includes hole 20' and pipe 20''. The vacuum operation is explained below. A motor (not shown) drives common shaft 14, thus rotating drums 16 simultaneously. Additional drums may be connected along the common shaft as required.

Along one side, in line, a plurality of signature-holding magazines 13 are coupled adjacent and facing drums 16. Signatures are stacked into the magazines 13 and are transferred individually, bottom first to the drum surface allowing for continuous loading. The magazines 13 are adjustable in length and width to accommodate various sized signatures. The base of magazine 13 is pivotable at —' and the back support of magazine 13 is pivotable at 13''.

Coupled between the magazines 13 and the drum 16 are a plurality of air jet bars 50 supported by arms 44 connected to cross-bar 42. Air under pressure is forced out through small apertures in bar 50 to separate like signatures to prevent the vacuum pickup boxes 46 or a sheet material separator device on the drum from picking up more than one signature.

Vacuum pickup boxes 46 are mounted on each drum surface for pulling the signature from the magazine 13 and holding the signature to the drum surface during transfer.

Mounted on the opposite side and below the drums is the signature collating tray 24 including fixed tray portion 24′ and adjustable tray portion 24″ adjacent to triangularly shaped reciprocating saddle 26 which includes pusher fingers 28, the saddle and fingers movably mounted on stationary support 30. Tray portion 24″ is adjustable up and down to accommodate different book widths. Mounting bracket 34 couples support 30 through plate 32 to plate 12. The saddle 26 is driven by a motor (not shown) in linear, reciprocating motion. The reciprocating saddle stroke is greater than the distance between adjacent plates 12 or adjacent pusher fingers 28. A guide 40, with adjusting cam means 38, holds the signature adjacent the drum 16 during transfer.

COLLATING MODE

Figure 3C:
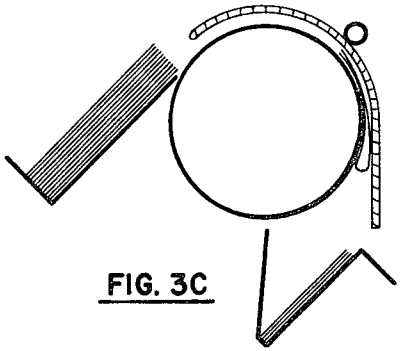
FIGS. 3A, 3B, and 3C, show schematically the operation of the signature-arranging invention for collating signatures in a collating tray.
Figure 3B:
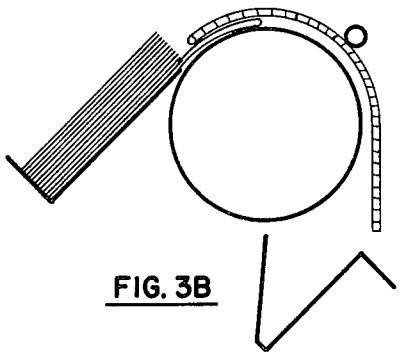
Figure 3A:
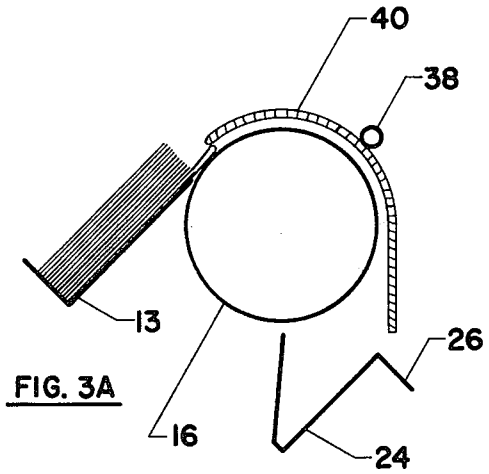

FIG. 3A shows the transfer cylinder 16 coupled to a signature so that a point on its surface is tangentially engaged with the bottom sheet of the signature stacked in the holding magazine 13. The bottom signature is held to the drum by a vacuum aperture and is rotated and taken from the magazine around the drum as it rotates. The signatures in the magazine are stacked with the backbones closer to and adjacent the drum.

FIG. 3B shows the signature removed from the holding magazine 13 and partially under guide 40.

Figure 2:
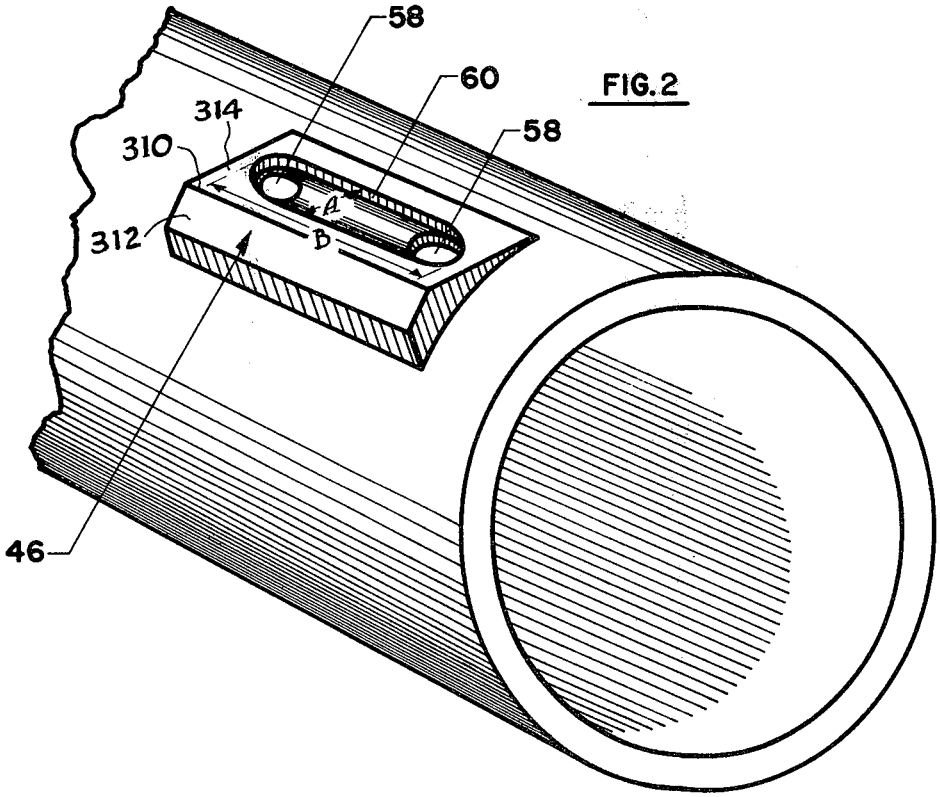
FIG. 2, shows a partial view in perspective of a transfer cylinder and vacuum aperture that may be utilized in various devices.

FIG. 3C shows the signature approximately 180° from its starting position at which point the vacuum holding the edge is released while the cylinder continues to rotate. The vacuum is controlled by an ordinary vacuum mask chamber 22. Approximately the same amount when the first signature is released another signature is removed from the bottom of the magazine and held on the cylinder by another vacuum pickup means at approximately 180° from the first vacuum pickup means. Once the vacuum on the cylinder aperture is released at the predetermined cylinder position, momentum will drive the signature down into the collating tray 24, backbone first. The signature is then moved along to the next drum with others that have been previously positioned in the same way. Since the signature was positioned within the magazine with the backbone adjacent the cylinder, the entire signature will move into the tray as shown in FIG. 3C. A plurality of cylinders and a collating tray are disposed along a linear axis and each signature group is transferred by the reciprocating saddle motion in the collating tray to the next stage or next cylinder. When another signature comes down and it is positioned adjacent the one previously deposited. Ultimately, at the end of the work line, the signatures will be stacked in a collated array, i.e., side-by-side, one on top of another as in FIG. 2B.

INSERTING MODE

Figure 4C:
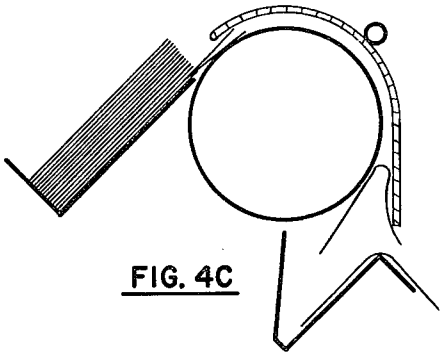
FIGS. 4A, 4B, 4C, show schematically the operation of the signature-arranging invention for inserting signatures into each other and onto a saddle.
Figure 4B:
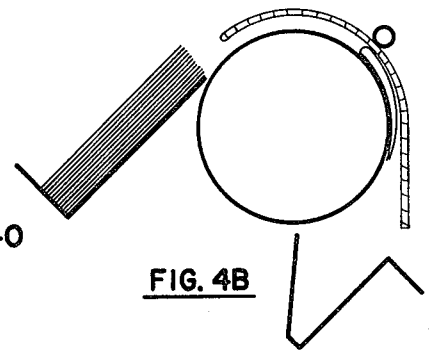
Figure 4A:
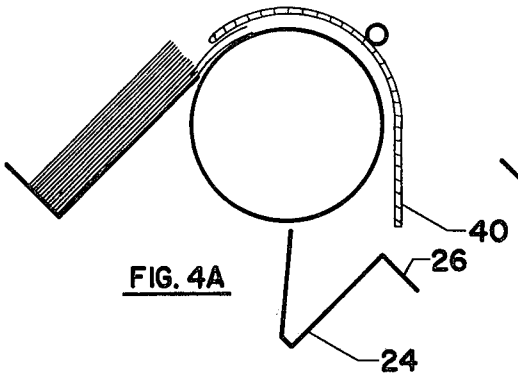

FIG. 4A shows the same device with the signatures arranged in the holding magazine 13 so that the signature open end or face is toward the cylinder (backbone reversed from collating). The signature will be held to the cylinder as it is pulled out of the holding magazine as shown in FIG. 4A. FIG. 4C shows a signature with the open-face down and the signature edge at the predetermined rotation position of the drum whereby one side of folded pages are still coupled to the drum by the vacuum, while the other side will open due to the centrifugal force of rotation and other means to open the signature as shown in FIGS. 4B and 4C. At a predetermined position, the vacuum is shut off which disengages the signature from the drum. Momentum and gravity drives the signature onto the saddle apex. Thus, the signature straddles the saddle 26, the backbone being along the top of the saddle. After receipt on the saddle as shown in FIG. 4C, the signatures will move in a group to the next stage where another signature will be dropped on top of the previously positioned one. Thus, a plurality of signatures will be stacked inside each other and will be moved as a unit until the requisite numbers have been stacked together and thereafter they will be moved to the next operation station.

FIG. 2 shows a transfer cylinder with a vacuum pickup box or sheet material separator device 46 with vacuum aperatures 58 through the cylinder surface connected to the vacuum source. A channel or connecting means 60 links the apertures 58 along the surface. The pickup box 46 has an angled surface including flat contact surface 314 which contacts the bottom signatures' surface in the holding magazine. The angle insures flush engagement between the signature and flat contact surface 314.

A vacuum tube which rotates with the drum is connected to the apertures 58 at one end and adjacent mask plate 20 at the other end. As the tube end passes vacuum mask chamber 22 (FIG. 1) the vacuum will be on. The operation of the vacuum system is well known and any conventional system may be utilized.

Figure 5:
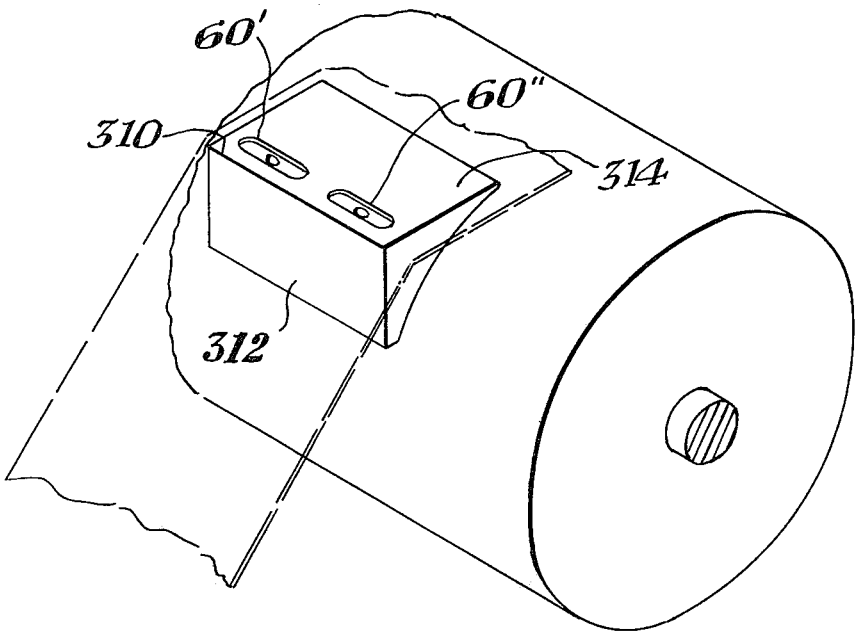
FIG. 5, is a perspective view of a pickup means.

Further reference is made to FIGS. 1, 2 and 5 showing the pickup box 46 with the single channel 60 in the upper plate. This structure may be modified by providing two channels with the same longitudinal center line instead of the single elongated channel 60. The two channels 60′ and 60″ provide positive pickup of the next sheet of material to be moved from the magazine 13. The two channels 60′ and 60″ are preferrably narrower in width than channel 60 with each of the two channels having a longitudinal length less than one half of the longitudinal dimension B. Surface 312′ in FIG. 5 preferrably falls off from surface 314 at a 90° angle. The two channels are placed close to the edge or breaking line 310 with their longitudinal center lines generally parallel to the edge 310. After the material is attached to surface 314 and the movement of the drum causes the forward edge of the adjacent or attached sheet of material to move away from its original plane of rest. The edge 310 of the pickup box 46 is used to brake the material, that is, to crease the material over edge 310. The movement of the adjacent sheet of material aids in separating the adjacent sheet of material from the other sheets in the magazine and/or the other sheets in the signature.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A sheet material separator device for moving a first sheet of material from generally flat overlying sheets of material comprising:

a base member, a first sheet contact member including a generally flat contact surface with a leading edge, a breaking means positioned above and rearward of said leading edge of said contact surface, and a following surface, said contact member movably connected to said base member for arcuate movement into engagement with and away from the generally flat overlying sheets, said contact surface positioned forward in reference to the direction of movement of said contact member of said breaking means, said breaking means positioned forward of said following surface, said breaking means being a line forming the common boundary between said contact surface and said following surface, said following surface positioned to prevent direct contact of said following surface with the first sheet during initial movement of the first sheet after said contact surface engages the first sheet and begins separating the first sheet from the overlying sheets, a connecting means connected in said contact surface for holding a contact portion of the first sheet of material in generally fixed engagement with said contact surface and generally over said breaking means, said connecting means being generally surrounded by said contact surface and being smaller in surface area than said contact surface, moving means connected to and between said base member and said contact member for moving said contact member in a path to and from the generally flat overlying sheets said following surface falling away from said breaking means in the direction opposite to the direction of movement of said contact member and toward said moving means, said breaking means aiding in separating said contact surface of said first sheet from said generally flat overlying sheets during the initial movement of said contact member.

2. A device for moving a first sheet of material from another generally flat overlying sheet of material as set forth in claim 1 wherein;

said connecting means is a vacuum system for holding said contact portion of a first sheet.

3. A device for moving a first sheet of material from another generally flat overlying sheet of material as set forth in claim 1 including, a rotary drum having an arcuate surface movably connected to said base member, said contact member and breaking means connected to said arcuate surface, and projecting outwardly from said arcuate surface.

4. A device for moving a first sheet of material from another generally flat overlying sheet of material as set forth in claim 3 wherein, said connecting means is a releasable means, said contact surface is generally tangentially orientated in relation to the arcuate surface of said drum, and said breaking means is formed by a breaking surface between the trailing edge of said contact surface and said arcuate surface of said drum.

5. A device for moving a first sheet of material from another generally flat overlying sheet of material as set forth in claim 4 wherein, the leading edge of said contact surface is in direct contact with said arcuate surface of said drum.

6. A device for moving a first sheet of material from another generally flat overlying sheet of material as set forth in claim 5 including, a signature magazine means for holding a stack of signatures of material, said magazine means connected to said base member and positioned adjacent said drum for individually transferring a signature of material, said contact surface moves into contact with the adjacent sheet of the signature of material in said stack to move said adjacent signature of material out of said stack.

7. A device for moving a first sheet of material from another generally flat overlying sheet of material as set forth in claim 6 wherein, said signature magazine means is an insert signature material magazine with an open portion of the folded sheets in a leading position, whereby said leading portion of the first signature is contacted by said contact surface, and said breaking means and the rotating drum moves at least the first sheet of the signature away from at least one of said generally flat overlying sheets to open the signature material for inserting one inside the other signatures for signature arranging purposes.

8. In a signature arranging and transfer device having a storage tray for receiving signatures, a rotatable vacuum transfer drum positioned adjacent said storage tray for individually transferring a signature; a vacuum producing means connected to the transfer drum; and a signature receiving means disposed adjacent said transfer drum for receiving individually deposited signatures from said transfer drum, the improvement comprising:

a raised generally flat contact surface with a trailing breaking edge projecting above the cylindrical exterior surface of the drum, said flat surface having a leading edge and a rearward trailing breaking edge, at least one vacuum aperture positioned in said flat contact surface and connected to the vacuum producing means, said flat contact surface being positioned in a tangential plane from the circumferential outer surface of the drum with the leading edge of said outer flat contact surface positioned on the cylindrical surface of the drum, said flat contact surface adapted to engage a signature from said storage tray for transfer.

* * * * *